US005280666A

United States Patent [19]

Wood et al.

[11] Patent Number: 5,280,666

[45] Date of Patent: Jan. 25, 1994

[54] SQUEEGEE APPARATUS FOR A VACUUM CLEANER SYSTEM

[75] Inventors: Stephen J. Wood; Steven R. Selewski; Roy O. Erickson, Jr., all of Cadillac, Mich.

[73] Assignee: Rexair, Inc., Troy, Mich.

[21] Appl. No.: 904,181

[22] Filed: Jun. 25, 1992

Related U.S. Application Data

[63] Continuation-in-part of Ser. No. 885,504, May 19, 1992, abandoned.

[51] Int. Cl.[5] ..... A47L 9/06

[52] U.S. Cl. ..... 15/401; 15/328; 15/367

[58] Field of Search ..... 15/320-322, 15/328, 367, 401

[56] References Cited

U.S. PATENT DOCUMENTS

| | | | |
|---|---|---|---|
| 850,909 | 4/1907 | Diserens . | |
| 1,633,598 | 6/1927 | McClatchie . | |
| 1,849,663 | 3/1932 | Finnell . | |
| 2,635,277 | 4/1953 | Belknap | 15/401 X |
| 2,677,144 | 5/1954 | Parry | 15/402 |
| 2,867,835 | 1/1959 | Brown, Jr. et al. | 15/401 X |
| 2,909,800 | 10/1959 | Grindle et al. | 15/321 |
| 3,064,300 | 11/1962 | Smith | 15/322 |
| 3,110,052 | 11/1963 | Whitman | 15/117 |
| 3,118,165 | 1/1964 | Meyerhoefer | 15/402 |
| 3,206,787 | 9/1965 | Daniels et al. | 15/320 |
| 3,332,101 | 7/1967 | Leinfelt et al. | 15/321 |
| 3,538,535 | 11/1970 | Ginsburgh et al. | 15/321 |
| 3,571,841 | 3/1971 | Crouser | 15/401 |
| 4,413,372 | 11/1983 | Berfield | 15/401 X |
| 4,475,265 | 10/1984 | Berfield | 15/401 X |
| 4,557,013 | 12/1985 | Belmont | 15/401 |
| 4,864,681 | 9/1989 | Hult et al. | 15/401 X |
| 5,054,156 | 10/1991 | Watanabe et al. | 15/401 X |

FOREIGN PATENT DOCUMENTS

| | | | |
|---|---|---|---|
| 855613 | 12/1960 | United Kingdom | 15/401 |

*Primary Examiner*—Stephen F. Gerrity
*Attorney, Agent, or Firm*—Harness, Dickey & Pierce

[57] ABSTRACT

A squeegee apparatus for a vacuum cleaner system. The apparatus includes a main body portion having an integrally formed neck portion operable to releasably connect to a wand of the vacuum cleaner system. The main body portion forms a manifold and includes a lower end portion to which a squeegee member is releasably secured. The squeegee member includes a central portion having a pair of longitudinally parallel extending bumper portions, with the bumper portions each including saw tooth-shaped surfaces. The squeegee blade also depends downwardly from the central portion and outwardly of the bumper portions. The central portion also includes first and second pluralities of ports disposed on opposite sides of the squeegee blade, with one or the other of the pluralities of ports being alternately blocked off during use as the squeegee blade flexes into abutting contact with one or the other of the bumper portions while being moved back and forth over a work surface. The bumper portions also function to maintain the pluralities of ports at a predetermined distance from the work surface during use, thereby maximizing the consistency of the liquid pick-up operation of the apparatus.

16 Claims, 6 Drawing Sheets

24
22
42
17
30
18
28
20
7
26
12
44
46
22A
22B
36
40
48
50

SQUEEGEE APPARATUS FOR A VACUUM CLEANER SYSTEM

CROSS REFERENCE TO RELATED APPLICATIONS

The present application is a continuation-in-part application of pending U.S. application Ser. No. 07/885,504, filed May 19, 1992, and abandoned.

TECHNICAL FIELD

This invention is related to squeegee assemblies, and more particularly to a squeegee attachment apparatus for a vacuum cleaner system to work in cooperation with the vacuum force generated by the vacuum cleaner system to remove liquid from a work surface.

BACKGROUND

Squeegee devices are used in a wide variety of applications to help remove liquid from work surfaces such as floors. Such devices may, in some cases, be in the form of attachments adapted for use with vacuum cleaner systems to enable liquid being moved by the squeegee attachment to be withdrawn into a reservoir associated with a vacuum cleaner system equipped for wet pickup.

Although previous squeegee apparatus for vacuum cleaner systems have proven to be helpful in removing liquid from surfaces such as windows, floors, tables, etc., it would nevertheless be desirable to have a squeegee apparatus which even more effectively operated to remove water and other like liquids from a work surface as the attachment is moved across the work surface. It would further be desirable if such a squeegee attachment incorporated a removable squeegee member which could be easily removed by the user and replaced. This would eliminate the need to replace the entire squeegee apparatus, which may include one or more frame portions which are generally not affected by wear and tear to the same degree as the squeegee member itself.

It would further be desirable if such a squeegee attachment was operable to maintain the squeegee at a predetermined distance from the work surface, to thus optimize the performance of the squeegee attachment. This would also serve to enhance the consistency of the pickup of the squeegee by enabling individuals to use it without concentrating on maintaining it at a certain distance from the work surface.

Accordingly, it is a principal object of the present invention to provide a squeegee apparatus for a vacuum cleaner system which operates to more effectively and thoroughly pick up liquids such as water from a work surface.

It is a further object of the present invention to provide a squeegee apparatus that functions to maintain its distance from the work surface a constant, predetermined amount, to thereby provide consistent pickup results.

It is still a further object of the present invention to provide a squeegee apparatus for a vacuum cleaner system which is removable from a main body portion of the apparatus, thereby permitting the squeegee member of the apparatus to be replaced without disposing of the entire squeegee apparatus.

It is yet another object of the present invention to provide a squeegee apparatus for a vacuum cleaner system to which a brush may be releasably secured.

It is yet another object of the present invention to provide a squeegee apparatus for a vacuum cleaner system where the squeegee apparatus has a neck portion which may be pivotally coupled to a wand, thus enabling the squeegee apparatus to pivot during use.

It is yet another object of the present invention to provide a squeegee apparatus for a vacuum cleaner system, where the squeegee apparatus is relatively easy and inexpensive to construct, and relatively light in weight.

SUMMARY OF THE INVENTION

The above and other objects are accomplished by a squeegee apparatus in accordance with preferred embodiments of the present invention. In a preferred embodiment the apparatus generally includes a main body portion which may be coupled to a vacuum hose or wand of a main vacuum unit. The main body portion forms a manifold which distributes the vacuum force generated by the main vacuum unit across an area having a predetermined shape as the apparatus is moved over a work surface.

The main body portion includes a lower end portion to which a removable squeegee member is secured. The squeegee member generally includes a central portion from which a pair of laterally spaced apart and downwardly depending front and rear bumper portions extend. A squeegee blade extends between the front and rear bumper portions and is disposed generally centrally between the bumper portions. A first plurality of ports is also disposed in the central portion on one side of the squeegee blade, while a second plurality of ports is disposed in the central portion on the opposite side of the squeegee blade.

As an operator urges the squeegee apparatus in a first direction, the squeegee blade flexes into abutting engagement with one of the bumper portions, thereby blocking the vacuum airflow through one of the pluralities of ports. As the squeegee apparatus is moved in an opposite, longitudinal direction, the squeegee blade flexes in the opposite direction into abutting engagement with the other bumper portion, thereby blocking off the other plurality of ports. Accordingly, as the squeegee apparatus is moved back and forth over a work surface, the squeegee blade flexes back and forth to alternately block one plurality of ports or the other to thereby increase the suction force through the open plurality of ports, and thus the ability of the squeegee apparatus to more effectively pick up water and other like liquids from the work surface. The bumper portion also functions to maintain the squeegee apparatus at a predetermined distance from the work surface to optimize the vacuum pickup operation of the squeegee apparatus. By maintaining a consistent distance from a work surface, virtually all users of the squeegee apparatus are able to achieve excellent results when using the apparatus regardless of their prior experience with squeegee devices.

The preferred embodiment also incorporates an optional, releasably attachable brush. By controlling the orientation of the squeegee apparatus relative to the work surface, either the squeegee member or brush of the apparatus may be used alternately while cleaning a work surface.

In an alternative preferred embodiment, the central portion of the squeegee member includes only one plurality of ports on one side of the squeegee blade and at least one tab portion on one wall portion. The single plurality of ports enables an even stronger suction force to be developed for applications where such is desirable. The tab portion enables a user to easily orientate the squeegee member when attaching it to the main body portion to ensure that the plurality of ports is disposed on the desired side of the squeegee blade to enable a suction action either while pushing or while pulling the apparatus, as desired by the user.

BRIEF DESCRIPTION OF THE DRAWINGS

Other objects, advantages and features of the present invention will become apparent to one skilled in the art upon reading the following description and appended claims, taken in conjunction with the following drawings wherein:

FIG. 12 is an enlarged, fragmentary, cross sectional view of the apparatus in accordance with section line 12—12 of FIG. 2 showing how the optional brush is secured via a locking shoulder portion to a frame rail portion of the main body portion of the squeegee apparatus;

DETAILED DESCRIPTION OF THE PREFERRED EMBODIMENTS

Figure 1:
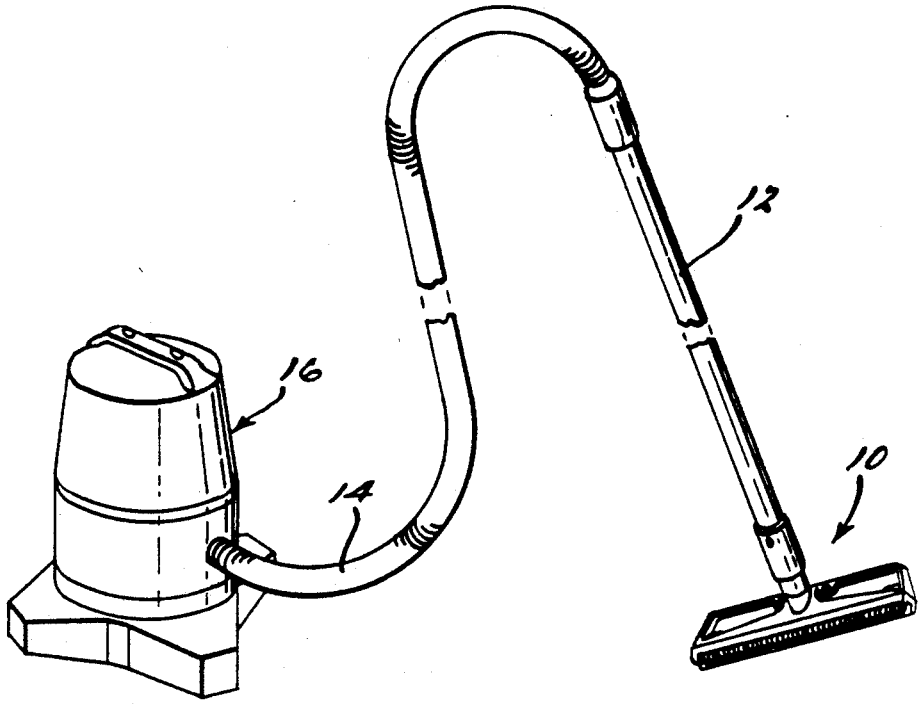
FIG. 1 is an elevational perspective view of a squeegee apparatus in accordance with a preferred embodiment of the present invention showing the apparatus releasably coupled to a vacuum cleaner system and including an optional, releasably attachable brush.

Referring to FIG. 1, there is shown a squeegee attachment apparatus 10 in accordance with a preferred embodiment of the present invention. The apparatus 10 is illustrated releasably coupled to an extension wand 12, which is in turn coupled to a flexible vacuum hose 14. The vacuum hose 14 is coupled to a main vacuum unit 16. The main vacuum unit 16 generates a vacuum force for drawing liquid collected by the squeegee apparatus 10 through the apparatus 10, the wand 12, and the vacuum hose 14 where it is collected within a reservoir within the main vacuum unit 16.

Figure 3:
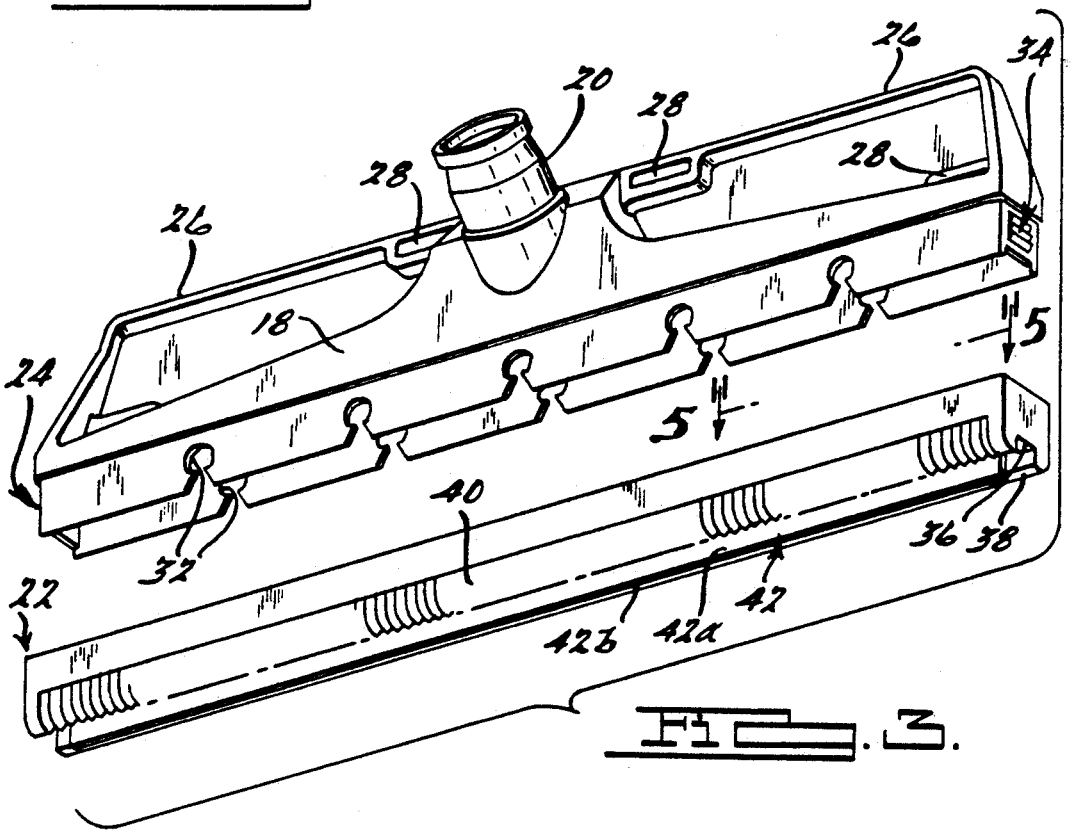
FIG. 3 is an exploded rear perspective view of the apparatus showing the squeegee member removed from the main body portion.
Figures 2, 4, 5:
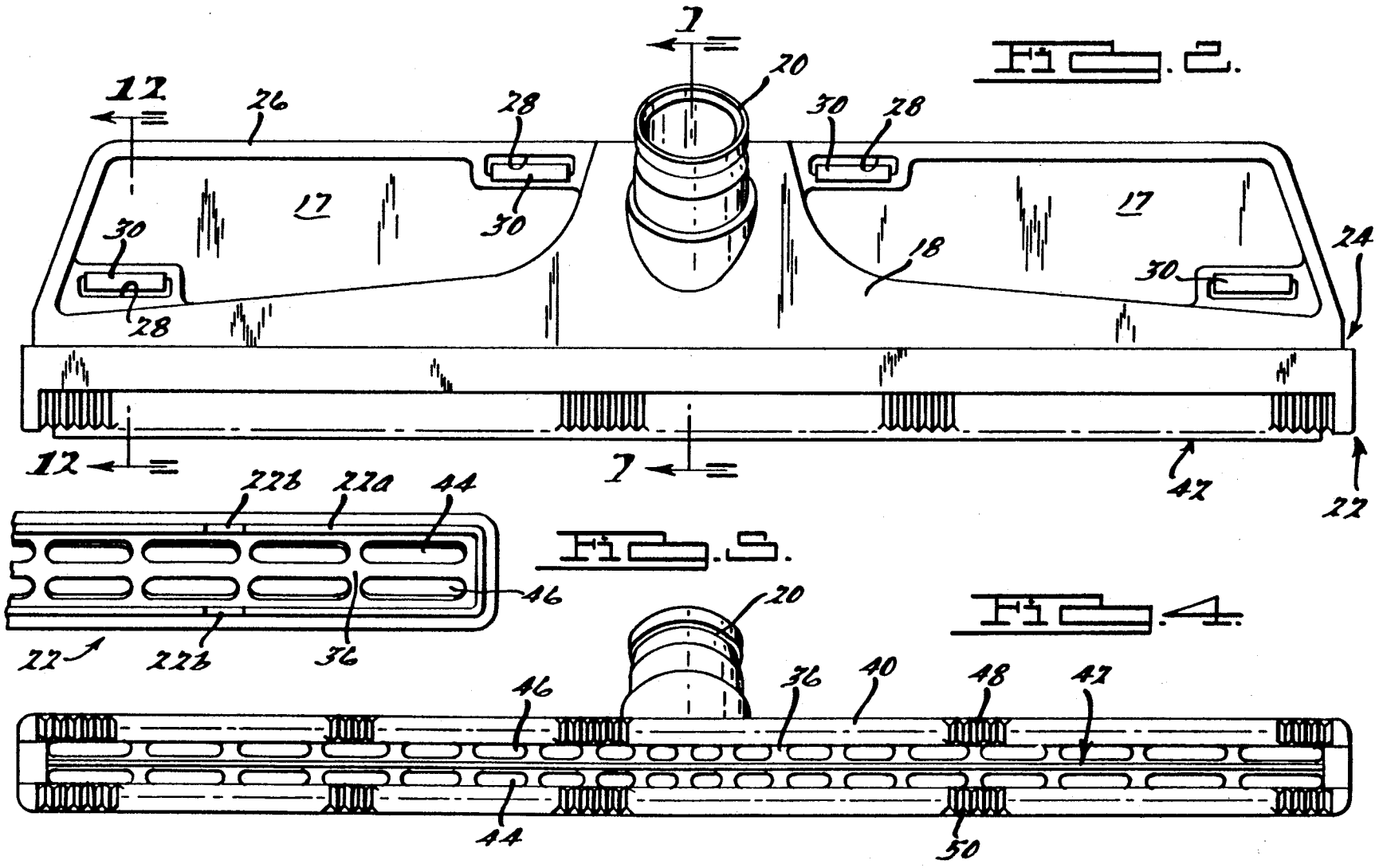
FIG. 2 is a rear view of the squeegee apparatus.
FIG. 4 is a bottom view of the apparatus showing in detail the ports of the squeegee member through which the vacuum force generated by the main vacuum unit is directed.
FIG. 5 is a fragmentary plan view of the squeegee member in accordance with section line 5—5 of FIG. 3 showing a portion of the upper surface of the central portion.

Referring now to FIGS. 2 through 4, the squeegee apparatus 10 is shown in detail. The preferred embodiment of the apparatus 10 includes a removably secured brush 17. It should be appreciated, however, that the brush 17 is completely optional and that the apparatus 10 can be used without it if so desired. The brush 17, however, serves to loosen dirt and other like debris from a work surface during cleaning of the surface.

Referring initially to FIG. 2, the apparatus 10 includes a main body portion 18 forming a manifold, with an integrally formed tubular neck portion 20 extending therefrom to which extension wand 12 may be pivotally, releasably attached. An independently formed squeegee member 22 is releasably secured to a lower end portion 24 of the main body portion 18. The main body portion 18 further includes a frame rail portion 26 which includes a plurality of apertures 28 through which locking arm portions 30 of the optional brush 17 protrude.

With specific reference to FIG. 3, the lower end portion 24 of the main body portion 18 includes a plurality of cut outs 32. Opposing ends of the lower end portion 24 each further include a plurality of locking shoulder portions 34 (only one of which is visible in the drawing of FIG. 3). The squeegee member 22 includes a central portion 36 having laterally spaced apart and longitudinally parallel extending front rear bumper portions 38 and 40, respectively, depending downwardly from the central portion 36. Also depending downwardly from the central portion 36 and extending longitudinally between the bumper portions 38 and 40 is a squeegee blade 42 having an outermost edge portion **42*a* with a tip portion 42*b*. The squeegee blade 42 has a length sufficient to enable it to extend outwardly of the bumper portions 38 and 40 such that when it flexes during movement over a work surface such as a floor, it will abuttingly contact the front or rear bumper portions 38 or 40**.

Referring to FIG. 4, it can be seen that the central portion 36 includes a first plurality of ports 44 disposed in longitudinal alignment on one side of the squeegee blade 42. A second plurality of ports 46 are further disposed in longitudinal alignment on the opposite side of the squeegee blade 42.

With further reference to FIGS. 3 and 4, each of the front and rear bumper portions 38 and 40 include saw tooth-shaped lower edge portions 48 and 50, respectively. The edge portions 48 and 50 enable liquids such as water to pass below the bumper portions 38 and 40, while the ports 44 and 46 are maintained a predetermined distance from the work surface. This also improves the consistency of the pick-up results of the squeegee 10 and enables users who may have had little experience with prior art squeegee devices to obtain consistently excellent results.

Figure 6:
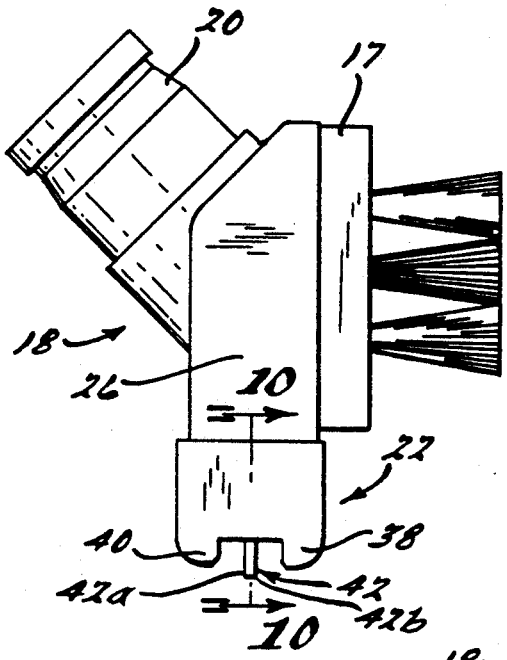
FIG. 6 is a side elevational view of the apparatus of the present invention showing an optional brush removably secured thereto, and the angular orientation of the brush relative to the squeegee member.

Referring briefly to FIG. 6, since the brush 17, when attached, is angled approximately 45 degrees from the squeegee member 22, the brush 17 need not be removed when it is desired to use the squeegee member 22. Accordingly, the squeegee member 22 and the brush 17 may be used alternately during a single cleaning operation by simply orientating the apparatus 10 in the appropriate position relative to the work surface.

Referring to FIG. 5, the squeegee member 22 includes a channel **22*a* circumscribing the central portion 36 and a plurality of locking portions 22*b* generally vertically aligned with respective ones of the cut-outs 32 (shown in FIG. 3). When the squeegee member 22 is secured to the lower end portion 24, the lower end portion 24 fits within the channel 22*a* and is secured thereto as locking portions 22*b* engage within the cut-outs 32**.

Figure 7:
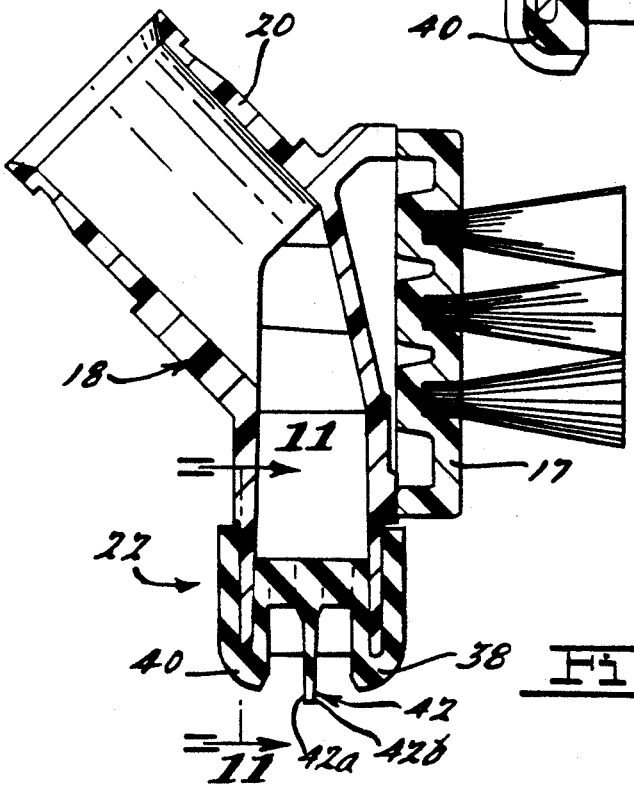
FIG. 7 is a cross sectional view of the apparatus in accordance with section line 7—7 of FIG. 2 showing the interior area of the main body portion.
Figure 10:
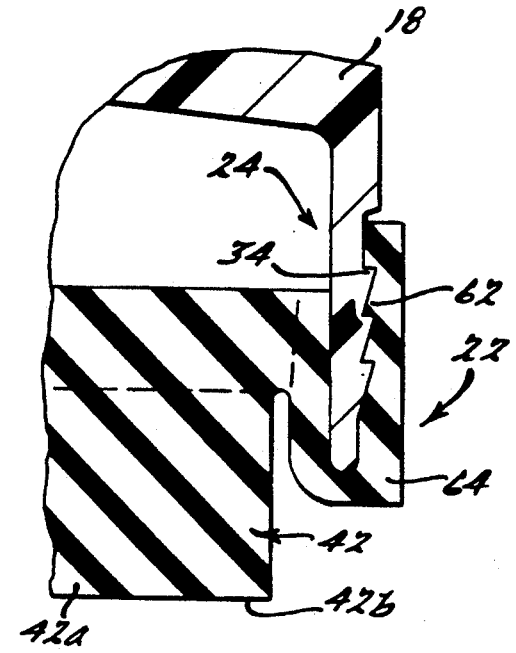

With reference to FIG. 7, the interior area of the apparatus 10 can be seen more clearly. During use of the wiper blade 42, the vacuum force generated by the main vacuum unit 16 draws air and liquid through the first and second pluralities of ports 44 and 46, respectively, through the main body portion 18, and through the neck portion 20.

Figure 8:
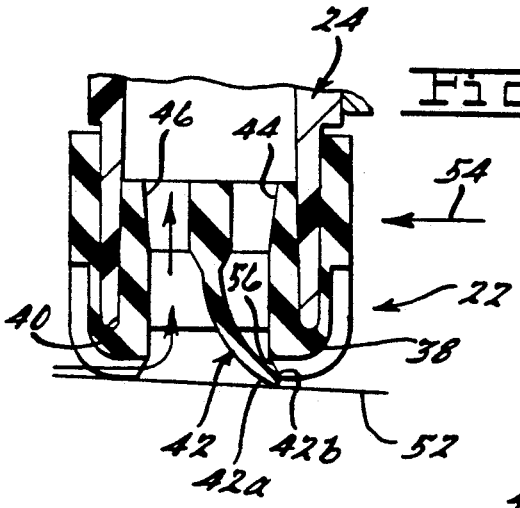
FIG. 8 is an enlarged fragmentary view, of the apparatus of FIG. 7 showing the squeegee blade flexing to block the first plurality of ports as the apparatus is moved in a first direction.

Referring to FIG. 8, as the squeegee apparatus 10 is moved over a work surface 52 in a first direction, as indicated by directional arrow 54, the squeegee blade 42 flexes to urge the tip portion **42*b* into abutting contact with an inner edge surface 56 of front bumper portion 38, thereby blocking the suction airflow through the first plurality of ports 44. The suction force through the second plurality of ports 46 is thus increased, thereby enabling liquids such as water to be more easily withdrawn by the apparatus 10** via the vacuum airflow.

Figure 9:
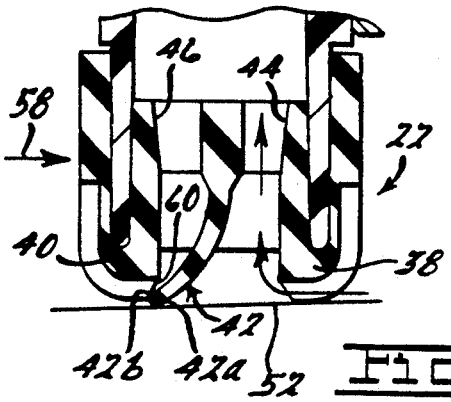
FIG. 9 is an enlarged fragmentary view of the apparatus of FIG. 7 showing how the squeegee blade flexes in the opposite direction as the apparatus is moved in a direction longitudinally opposite to the first direction, to thereby block the second plurality of ports.
Figure 13:
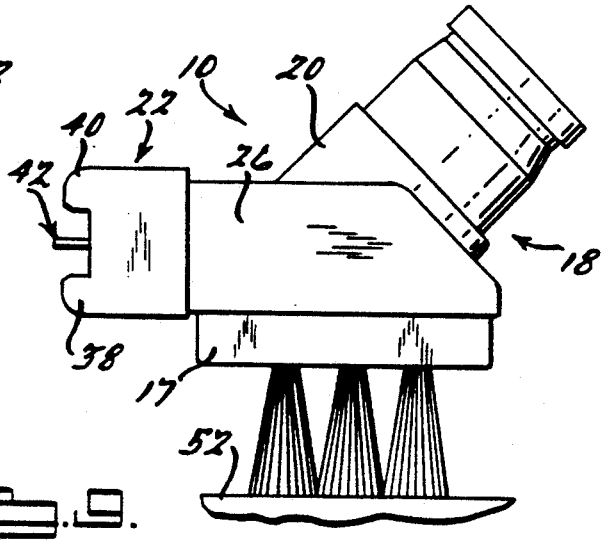
FIG. 13 is an elevational side view of the apparatus of FIG. 6 incorporating the optional brush, with the brush being moved over a work surface.

Referring to FIG. 9, as the squeegee apparatus 10 is moved in an opposite longitudinal direction, as indicated by directional arrow 58, the squeegee blade 42 flexes in the opposite direction to urge the tip portion **42*b* into abutting contact with an inner edge surface 60 of the rear bumper portion 40. This blocks the vacuum airflow through the second plurality of ports 46, thereby maximizing the vacuum suction force through the first plurality of ports 44, and thus enhancing the withdrawal of liquids through the first plurality of ports 44. Accordingly, as the squeegee apparatus 10 is moved longitudinally along the work surface in forward and backward movements, the vacuum airflow through the first and second pluralities of ports 44 and 46, respectively, is alternately enabled and blocked depending on the direction in which the squeegee apparatus 10** is being moved.

Figure 10:
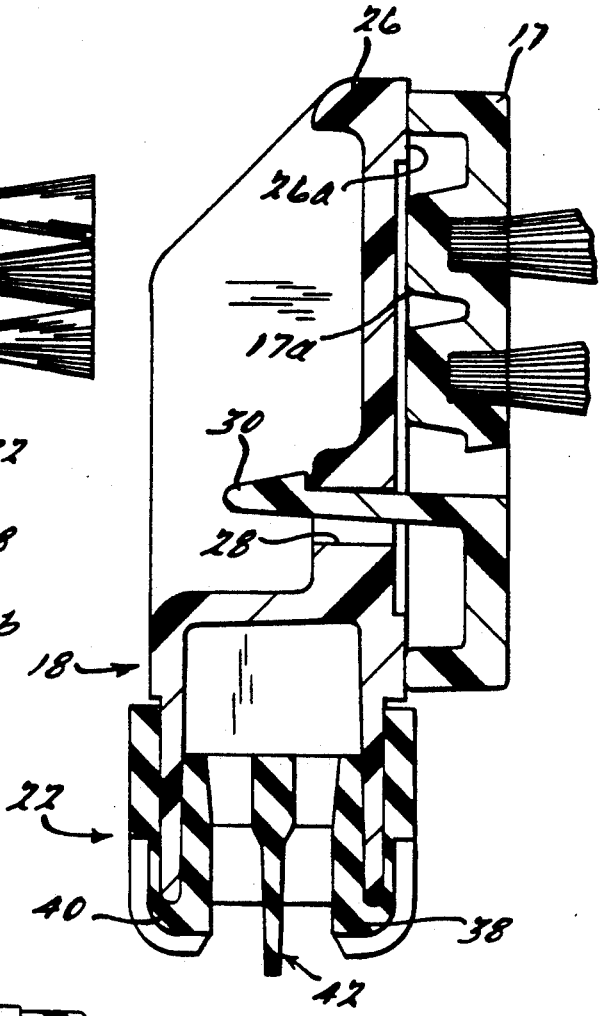
FIG. 10 is an enlarged cross sectional view of a portion of the apparatus in accordance with section line 10—10 of FIG. 6 showing how the squeegee member secures to a portion of the main body portion of the apparatus.
Figure 11:
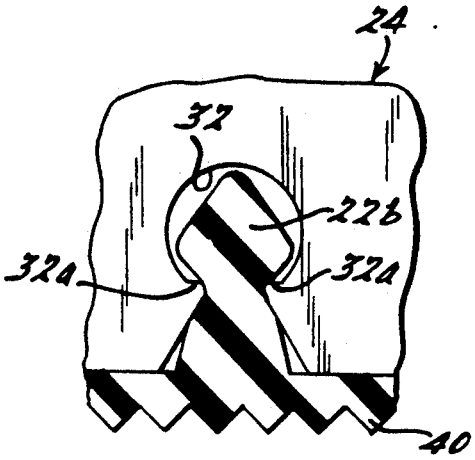
FIG. 11 is an enlarged, fragmentary, cross sectional view in accordance with section line 11—11 of FIG. 7 showing one of the locking portions of the squeegee member secured within a respective one of the cut-outs of the main body portion.

With reference to FIGS. 10 and 11, the manner in which the squeegee member 22 is secured to the lower end portion 24 of the main body portion 18 is illustrated. Referring initially to FIG. 10, the locking shoulder portions 34 of the lower end portion 24 releasably, lockably engage with symmetrically shaped locking shoulder portions 62 disposed on an interior surface **22*c* of opposing end portions 64 (one of which is shown in FIG. 10) of the squeegee member 22. To secure the squeegee member 22 to the main body portion 18, the squeegee member 22 is placed over the lower end portion 24 and urged thereover until the locking shoulder portions 34 and 62 are fully engaged as shown in FIG. 10**.

Referring briefly to FIG. 11, one of the locking portions **22*b* of the squeegee member 22 is illustrated secured to a corresponding cut-out 32 of the lower end portion 24 of the main body portion 18. It will be appreciated that while only one locking portion 22*b* is illustrated in FIG. 11, in fact, a corresponding plurality of locking portions 22*b* are included in accordance with the plurality of cut-outs 32 disposed on the lower end portion 24 and disposed in general vertical alignment with the cut-outs 32. As the squeegee member 22 is urged over the lower end portion 24, the locking portions 22*b* are urged into the areas defined by cut-outs 32 and are releasably held therein by a squeezing or pinching action exerted by edges 32*a* of each cut-out 32. Thus, no additional components are necessary to maintain the squeegee apparatus 10 releasably to the main body portion 18**.

A significant advantage of the squeegee apparatus 10 of the present invention is therefore the ability of the squeegee member 22 itself to be removed from the main body portion 18 for cleaning and/or discarded after prolonged use. Accordingly, the entire squeegee apparatus 10 need not be replaced in response to wear and tear of the squeegee member 22 itself. Thus, significant cost savings in some applications may be achieved where frequent replacement of the entire squeegee device is necessary although only the squeegee blade itself is excessively worn. An additional cost savings is realized because no additional component parts are required to releasably hold the squeegee member 22 to the main body portion 18.

The squeegee member 22 is preferably injection molded from rubber, and more preferably from Alcryn TM, a thermoplastic rubber commercially available from E.I. Du Pont de Nemours & Co., Inc., of Wilmington, Del. When manufactured from Alcryn TM, the squeegee member 22 forms a lightweight and relatively inexpensive component part, as compared to rubber, and may be easily attached, removed and discarded after prolonged use. It will be appreciated, however, that the squeegee member 22 could be made from a wide variety of rubber compounds, or rubber-like materials. The main body portion 18 is preferably injected molded as a single piece unit from acrylonitrile—butadiene—styrene (ABS) plastic.

With further regard to the squeegee member 22, the squeegee blade 42 preferably has a cross-sectional thickness in the range of about 1/32" to ⅛". The length of the squeegee member is such that its tip portion **42*b* (as shown particularly well in FIGS. 7–9) extends outwardly of the front and rear bumper portions 38 and 40, respectively, a distance within a range of preferably about 1/16" to ⅛". With the above dimensions, the squeegee blade 42 is able to flex easily into contact with the bumper portions 38 and 40 as the squeegee apparatus 20 is moved forward and backwards over a work surface. It will be appreciated, however, that the length of extension of the squeegee blade 42 outwardly of the bumper portions 38 and 40** may be varied slightly beyond the range of 1/16" to ⅛" to suit the needs of specific applications.

Referring briefly to FIG. 12, the removable coupling of the brush 17 to the frame rail portion 26 of the main body portion 18 is further illustrated. A top surface 17*a* of the brush 17 abuts a lower surface 26*a* of the frame rail portion 26 when the brush 17 is removably secured thereto. To attach the brush 17 the locking arm portions 30 (only one of which is visible in FIG. 12) are urged through the apertures 28. As they enter the apertures 28 the locking arm portions 30 flex slightly and releasably snap into engagement with upper surfaces 26*b* (one of which is shown in FIG. 12). To remove the brush 17, the locking arm portions 30 are urged simultaneously out of locking engagement with their respective apertures 28 and the brush 17 is pulled outwardly of the lower surface 26*a* of the frame rail portion 26.

It should also be appreciated that other cleaning implements such as a sponge could also be used in lieu of the brush 17 as may be required by specific applications. Moreover, the squeegee apparatus 10 could easily be adapted for use with other cleaning devices such spray devices and/or carpet cleaning attachments.

Figure 14:
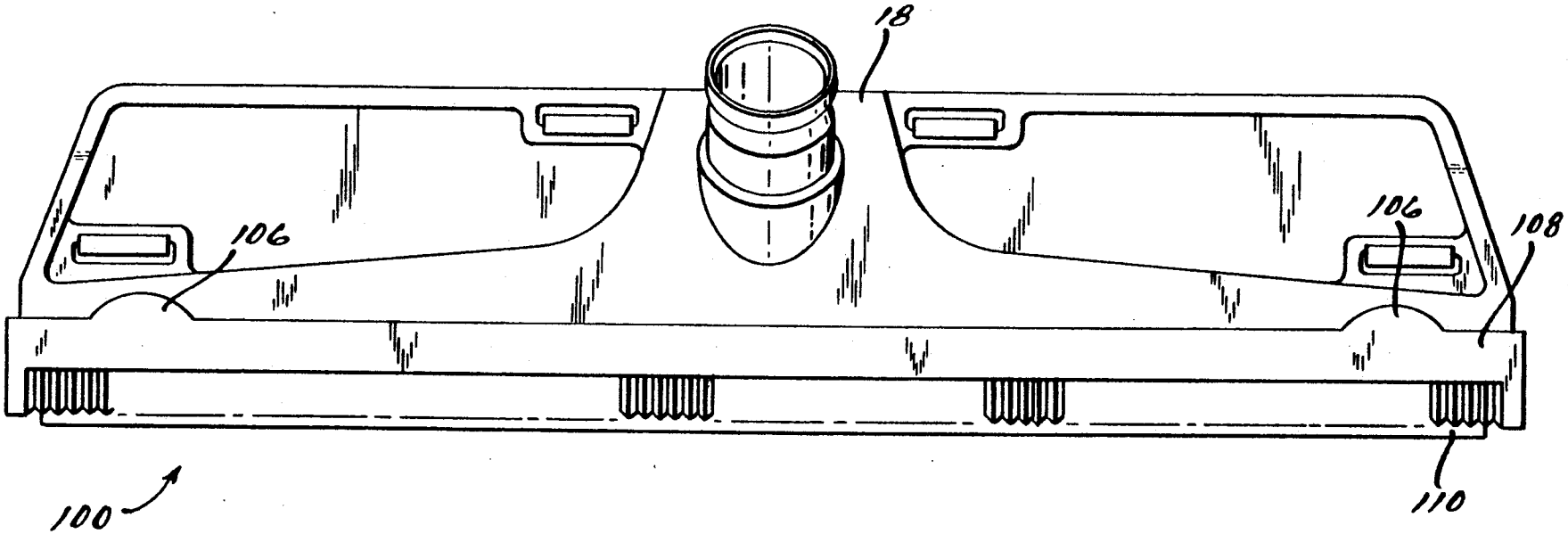
FIG. 14 is a rear elevational view of an apparatus in accordance with an alternative preferred embodiment of the present invention.
Figure 15:
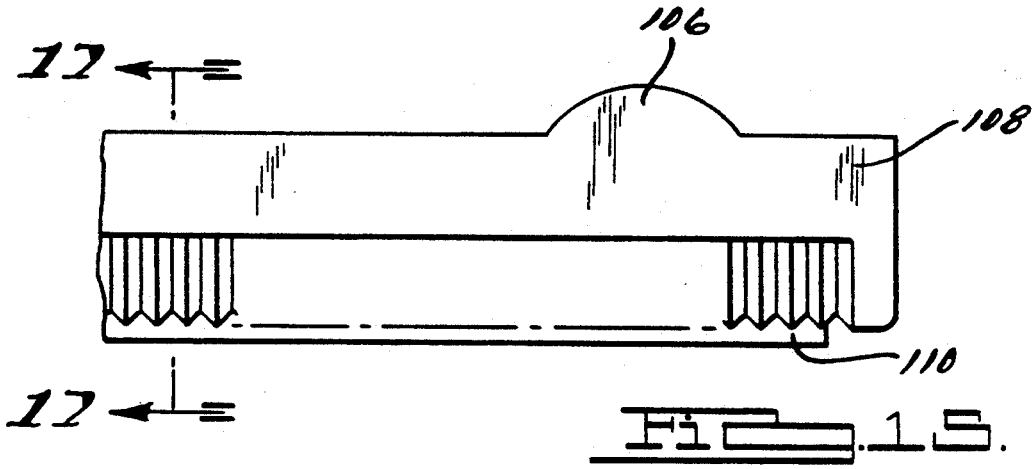
FIG. 15 is an enlarged rear elevational view of a portion of the apparatus of FIG. 14 showing one of the tab portions formed thereon.
Figure 16:
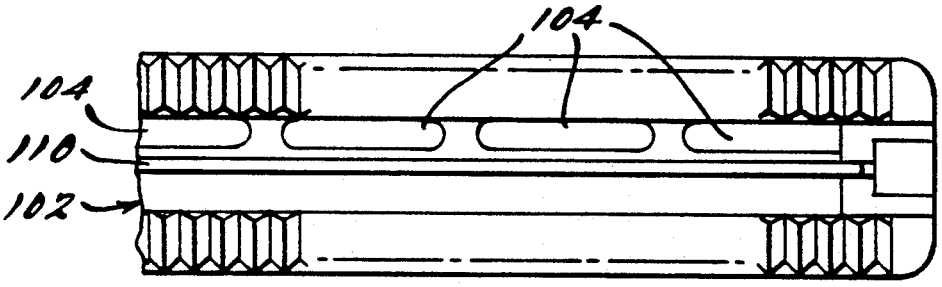
FIG. 16 is a bottom view of the apparatus of FIG. 15 showing a single plurality of ports on one side of the wiper blade.
Figure 17:
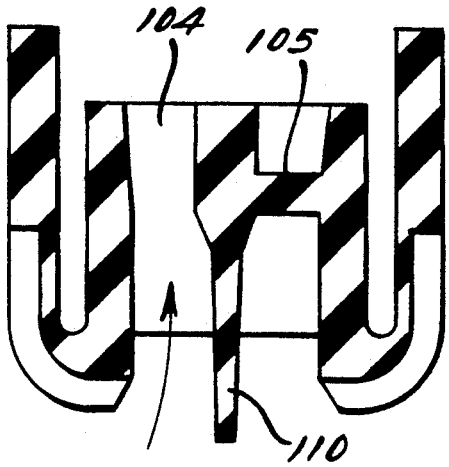
FIG. 17 is a cross sectional view of the apparatus of FIG. 15 taken in accordance with section line 17—17.

With reference to FIGS. 14–17, a squeegee member 100 in accordance with an alternative preferred embodiment of the present invention is shown. Referring specifically to FIGS. 15–17, squeegee member 100 is identical to squeegee member 22 in all respects with the exception of a central portion 102 (FIGS. 16 and 17) which includes only a single plurality of apertures 104 therein, and a pair of tab portions 106 (FIGS. 14 and 15) disposed on an outer wall portion 108 of the squeegee member 100.

Referring specifically to FIGS. 14 and 15, the plurality of ports 104 is disposed on a single side of a squeegee blade 110. A laterally projecting portion of material 105 blocks the air flow on the opposite side of the squeegee blade 110 of the squeegee member 100. Including a plurality of ports on one side only of the squeegee blade 110 enables an even stronger suction force to be developed when using the squeegee member 100.

Referring specifically to FIG. 14 and 15, the tab portions 106 allow the user to orientate the squeegee member 100 during installation such that a suction action will be enabled while either pushing or pulling the squeegee member 100 during use. With the squeegee member 100 secured to the main body portion 18 as shown in FIG. 14, a suction action will be enabled when the squeegee member 100 is pulled towards the user (i.e., to the left in FIG. 17) and obstructed when the squeegee member is moved away from the user (i.e., toward the right in FIG. 17). The squeegee member 100 is further manufactured from the same material as squeegee member 22 and formed in the same manner as member 22.

While the above description constitutes the preferred embodiments of the invention, it will be appreciated that the invention is susceptible to modification, variation, and change without departing from the proper scope or fair meaning of the accompanying claims.

We claim:

1. A squeegee apparatus for a vacuum cleaner system, said apparatus comprising:

main body means in communication with said vacuum cleaner system for directing a vacuum airflow generated by said vacuum cleaner system across a work surface;

a squeegee member removably coupled to said main body means, said squeegee member including a flexible squeegee blade, a plurality of ports formed adjacent and along one side of said flexible squeegee blade, said plurality of ports enabling said vacuum airflow to be directed through said squeegee member to said work surface, a front bumper extending longitudinally along said one side of said flexible squeegee blade and a rear bumper extending longitudinally along an opposite side of said flexible squeegee blade, said front and rear bumpers each having an inner edge surface and being operable to maintain said plurality of ports at a predetermined minimum distance from said work surface;

said flexible squeegee blade having an outermost edge portion having a tip portion for contacting the floor and being interposed between said front and rear bumpers and having a length sufficient to allow said tip portion thereof to make abutting contact with said floor and with said inner edge surface of one of said front and rear bumpers as said squeegee blade is moved in back and forth longitudinal movements;

wherein said flexible squeegee blade flexes to alternately enable and block said vacuum airflow through said plurality of ports as said apparatus is moved in said back and forth longitudinal movements over said work surface.

2. The apparatus of claim 1, wherein said squeegee member includes an outer wall portion and at least one tab portion disposed on said outer wall portion for enabling said squeegee member to be orientated as desired by a user when said squeegee member is coupled to said main body means.

3. A squeegee apparatus for a vacuum cleaner system, said apparatus comprising:

main body means in communication with said vacuum cleaner system for directing a vacuum airflow generated by said vacuum cleaner system across a work surface;

a squeegee coupled to said main body means, said squeegee including a flexible squeegee blade having an outermost edge portion having a tip portion for contacting said work surface, a first plurality of ports formed adjacent one side of said flexible squeegee blade and a second plurality of ports formed against the opposite side of said flexible squeegee blade;

a front bumper extending longitudinally along said one side of said flexible squeegee blade and having an inner edge surface;

a rear bumper extending longitudinally along said opposite side of said flexible squeegee blade and having an inner edge surface;

said front and rear bumpers maintaining said plurality of ports at a predetermined minimum distance from said work surface;

said first and second pluralities of ports enabling said vacuum airflow to be direction through said squeegee means to said work surface;

said squeegee blade having a length sufficient to cause said tip portion thereof to flex and to simultaneously contact said work surface and one of said inner edge surfaces as said squeegee apparatus is moved over a work surface in a first direction, and to contact said work surface and the other one of said inner edge surfaces when said apparatus is moved in a second direction over said work surface, to thus alternately block said vacuum airflow through one of said first and second pluralities of ports at a time as said apparatus is moved in back and forth longitudinal movements over said work surface to thereby alternately increase said vacuum airflow through said pluralities of ports.

4. The apparatus of claim 3, wherein said squeegee member is removably secured to said main body means.

5. A squeegee apparatus for a vacuum cleaner system, said apparatus comprising:

a main body portion forming a manifold;

said main body portion including a tubular neck portion in communication therewith to enable airflow through said neck portion and said main body portion; and squeegee means coupled to a lower end portion of said main body portion for facilitating the extraction of water from a work surface;

said squeegee means including a central portion having a squeegee blade, said squeegee blade having an outermost edge portion having a tip portion for wiping said liquid when said squeegee apparatus is manually moved over said work surface, said central portion further including a first plurality of ports disposed on one side of said squeegee blade and a second plurality of ports disposed on the opposite side of said squeegee blade;

said squeegee means further including means forming front and rear bumpers each having an inner edge surface extending generally parallel to said first and second pluralities of ports, said squeegee blade being operable to simultaneously contact said work surface and flex toward said front bumper means as the squeegee apparatus is moved in a first direction such that said tip portion simultaneously contacts said work surface and abuts said inner edge surface of said front bumper means, thereby generally blocking airflow through said first plurality of ports and increasing air flow through said second plurality of ports;

said squeegee blade further flexing towards said rear bumper means when said squeegee apparatus is moved in a second longitudinal direction opposite to said first direction such that said tip portion simultaneously contacts said work surface and said inner edge surface of said rear bumper means, thereby generally blocking airflow through said second plurality of ports and increasing airflow through said first plurality of ports.

6. The apparatus of claim 5, wherein said apparatus includes a brush removably secured to said main body portion.

7. The apparatus of claim 5, wherein said front and rear bumper means each include a saw tooth-shaped lower edge portion.

8. The squeegee apparatus of claim 5, wherein said main body portion includes means for releasably securing said squeegee means to said lower end portion at opposing end portions of said main body portion.

9. The apparatus of claim 5, wherein said main body portion includes a plurality of cut-outs formed in portions of said lower end portion; and wherein said squeegee means includes means forming locking portions operable to releasably lockably engage with said cut-outs to releasably secure said squeegee means to said main body portion.

10. For a vacuum cleaner system, a squeegee apparatus for removing liquid from a work surface such as a floor, said apparatus comprising:

a main body portion forming a manifold, said main body portion including a tubular neck portion in communication with an interior area of said main body portion, said main body portion further including a lower end portion;

a squeegee member releasably secured to said lower end portion of said main body portion;

said squeegee member including a central portion, laterally spaced apart and downwardly depending front and rear bumper portions each having an inner edge surface, and a downwardly depending squeegee blade extending outwardly between said front and rear bumper portions, said squeegee blade having an outermost edge portion with a tip portion for contacting said work surface;

said central portion of said squeegee member further including a first plurality of ports extending longitudinally along one side of said squeegee blade and a second plurality of ports extending longitudinally along the opposite side of said squeegee blade;

said squeegee blade being flexible to allow said tip portion to simultaneously contact said work surface and flex into abutting engagement with said inner edge surface of said front bumper portion when said squeegee apparatus is moved in a first direction, thereby blocking airflow through said first plurality of ports and increasing airflow through said second plurality of ports, and to permit said tip portion to flex towards said rear bumper portion such that said tip portion simultaneously contacts said work surface and said inner edge surface of said rear bumper portion when said squeegee apparatus is moved in a second direction opposite to that of said first direction, thereby blocking airflow through said second plurality of ports and increasing airflow through said first plurality of ports.

11. The apparatus of claim 10, wherein said main body portion includes a frame rail portion having a plurality of apertures for releasably securing a brush to said main body portion.

12. The apparatus of claim 10, wherein said apparatus further includes a brush; and wherein said main body portion further includes a frame rail portion having a plurality of apertures, said apertures enabling said brush to be releasably coupled to said main body portion.

13. The apparatus of claim 10, wherein said squeegee member further includes a plurality of shoulder portions; and wherein said main body portion further includes a plurality of mating shoulder portions on opposing end portions of said lower end portion, said shoulder portions of said squeegee member and said opposing end portions of said lower end portion mating together to releasably secured said squeegee member to said lower end portion of said main body portion.

14. The apparatus of claim 13, wherein said squeegee member further includes a plurality of locking portions formed between each of said front and rear bumper portions and said central portion; and wherein said lower end portion of said main body portion includes a plurality of cut-outs in alignment with said locking portions such that said locking portions are at least partially received within said cut-outs when said bumper is releasably secured to said lower end portion of said main body portion.

15. An apparatus for removal of liquid from a work surface such as a floor comprising:

a main vacuum unit for generating a vacuum force;

a vacuum hose coupled to said main vacuum unit;

a detachable tubular wand coupled to said vacuum hose;

a squeegee attachment releasably, pivotally coupled to said wand;

said squeegee attachment including a main body portion forming a manifold, a neck portion in communication with an interior area of said main body portion and also with said wand for enabling a vacuum force to be direction through said interior area, said main body portion further including a lower end portion;

a squeegee member releasably secured to said lower end portion, said squeegee member including a central portion, a pair of front and rear parallel, longitudinally extending bumper portions depending downwardly from said central portion and each having an inner edge surface, a squeegee blade extending longitudinally between said front and rear bumper portions and depending outwardly from said central portion and having an outermost edge portion with a tip portion for contacting said work surface;

said central portion of said squeegee member including a first plurality of ports disposed along one side of said squeegee blade and a second plurality of ports disposed along the opposite side of said squeegee blade, said tip portion of said squeegee blade being operable to flex such that said tip portion simultaneously contacts said work surface and said inner edge surface of said front bumper portion to thereby block airflow through said first plurality of ports when said squeegee attachment is moved in a first direction along said work surface, and to flex such that said tip portion simultaneously contacts said work surface and said inner edge surface of said rear bumper portion to thereby block airflow through said second plurality of ports when said squeegee attachment is moved in a direction longitudinally opposite to said first direction.

16. The apparatus of claim 15, wherein said squeegee attachment further includes a brush removably coupled to said main body portion.

* * * * *